US006976660B2

(12) United States Patent
Lapointe et al.

(10) Patent No.: US 6,976,660 B2
(45) Date of Patent: Dec. 20, 2005

(54) OUTDOOR SIGN SUPPORT SYSTEM

(75) Inventors: Jean Lapointe, Laval (CA); Robert Griffith, Repentigny (CA)

(73) Assignee: Signalisation Kalitec inc., Laval (CA)

( * ) Notice: Subject to any disclaimer, the term of this patent is extended or adjusted under 35 U.S.C. 154(b) by 0 days.

(21) Appl. No.: 10/732,400

(22) Filed: Dec. 11, 2003

(65) Prior Publication Data

US 2005/0127258 A1 Jun. 16, 2005

(51) Int. Cl.[7] ..... A47B 96/06; G09F 15/00

(52) U.S. Cl. ..... 248/218.4; 248/219.1; 40/607.12; 40/604

(58) Field of Search ..... 248/218.4, 219.1, 248/219.2, 219.3, 222.14, 222.13, 223.41, 248/224.61, 227.3; 40/607.12, 604

(56) References Cited

U.S. PATENT DOCUMENTS

| | | | | | |
|---|---|---|---|---|---|
| 150,320 | A | * | 4/1874 | Hills | 211/77 |
| 159,550 | A | * | 2/1875 | King | 40/607.12 |
| 730,675 | A | * | 6/1903 | Macklin | 211/166 |
| 1,088,324 | A | * | 2/1914 | Corkhill | 248/218.4 |
| 1,480,606 | A | | 1/1924 | Fetters | |
| 1,625,319 | A | * | 4/1927 | Kenerson | 248/230.9 |
| 1,786,883 | A | * | 12/1930 | Zahonyi | 40/607.12 |
| 1,996,541 | A | | 4/1935 | Fetters | |
| 2,113,180 | A | * | 4/1938 | Klein | 40/607.12 |
| 2,262,873 | A | * | 11/1941 | Wise | 40/607.12 |
| 2,716,533 | A | * | 8/1955 | Freeman | 211/107 |
| 2,802,291 | A | | 8/1957 | Bach et al. | |
| 3,034,242 | A | * | 5/1962 | Gold | 40/604 |
| 3,263,356 | A | * | 8/1966 | Gilmoure et al. | 40/604 |
| 3,332,654 | A | * | 7/1967 | Jacobson | 211/107 |
| 3,341,959 | A | * | 9/1967 | Sabadics | 40/607.12 |
| 3,503,580 | A | * | 3/1970 | Levy | 248/62 |
| 3,550,297 | A | * | 12/1970 | Friedrichsen | 40/603 |
| 3,574,449 | A | | 4/1971 | Rosenberg | |
| 3,589,048 | A | * | 6/1971 | Mollet et al. | 40/603 |
| 3,593,450 | A | * | 7/1971 | Mollet et al. | 40/604 |
| 3,609,894 | A | * | 10/1971 | Miller, III | 40/655 |
| 3,654,718 | A | * | 4/1972 | Bianchi | 40/607.12 |
| 3,886,676 | A | | 6/1975 | Alfonso | |
| 3,894,707 | A | * | 7/1975 | Heard | 248/230.9 |
| 3,943,646 | A | | 3/1976 | Branham | |
| 4,059,914 | A | | 11/1977 | Dobson | |
| 4,117,629 | A | * | 10/1978 | Ekdahl | 47/67 |
| 4,211,381 | A | | 7/1980 | Heard | |
| 4,493,468 | A | * | 1/1985 | Roach | 248/62 |
| 4,514,103 | A | * | 4/1985 | Wise et al. | 138/106 |
| 4,890,403 | A | * | 1/1990 | Dinan | 40/604 |
| 4,930,436 | A | * | 6/1990 | Newman | 73/170.05 |
| 5,088,672 | A | * | 2/1992 | Neuendorf et al. | 248/218.4 |

(Continued)

*Primary Examiner*—Anita M. King
(74) *Attorney, Agent, or Firm*—Ogilvy Renault

(57) ABSTRACT

A system for mounting a sign to a post comprises an elongated channel member adapted to be mounted on a backside of a sign and a bracket adapted to be mounted to a post to which the sign is to be mounted. The bracket has a channel engaging portion adapted to be slidably engaged into the channel member on the backside of the sign. The bracket comprises an endless collar extending along a continuous closed line and adapted to be fitted over the post. The collar defines at least one transversally oriented hole in which a threaded fastener is threadably engaged with a leading end thereof projecting inwardly of the continuous endless collar for exerting a pushing action on the post in order to secure the collar on the post while at the same time drawing the channel member against the post so as to prevent relative movement between the sign and the bracket.

13 Claims, 3 Drawing Sheets

U.S. PATENT DOCUMENTS 5,320,312 A * 6/1994 Hoenninger ..... 248/68.1
D357,172 S * 4/1995 Hsu ..... D8/354
5,428,913 A * 7/1995 Hillstrom ..... 40/604
5,575,580 A * 11/1996 Parrish et al. ..... 403/49
5,590,504 A 1/1997 Heard et al.
5,738,317 A * 4/1998 Hugron ..... 248/176.1
6,250,596 B1 * 6/2001 Gordin et al. ..... 248/230.1
6,550,170 B1 * 4/2003 Cooper et al. ..... 248/218.4
6,618,973 B2 * 9/2003 Nelson ..... 40/604
2002/0096610 A1 * 7/2002 Fernandez ..... 248/218.4

* cited by examiner

OUTDOOR SIGN SUPPORT SYSTEM

BACKGROUND OF THE INVENTION

1. Field of the Invention

The present invention relates to a system suitable for mounting a sign or the like, to an outdoor post.

2. Description of the Prior Art

U.S. Pat. No. 4,211,381 issued on Jul. 8, 1980 to Heard discloses a device for mounting a sign to a post. The mounting device comprises a channel member mounted on the backside of the sign and a plastically deformable stainless steel strip. The channel member comprises a pair of inturned lips defining therebetween a mouth. The strip comprises an elongated plate adapted to be slidably engaged in the channel member behind the inturned lips. The free ends of the strip are turned outwardly to provide a pair of mutually facing flanges. The flanges define a paid of holes aligned along a direction tangential to the post. The flanges are secured together by a bolt and a nut. By tightening the bolt, the strip is plastically deformed in tight engagement about the post. This causes the elongated plate to be draw against the inside surface of the inturned lips of the channel member, thereby providing a resistance to the movement of the plate in the channel member.

Although the above described attachment system provides flexibility in the adjustment of the position of the sign on the post, it has been found that the strip may become loose overtime, which may result in accidental detachment of the sign from the post.

SUMMARY OF THE INVENTION

It is therefore an aim of the present invention to provide a new outdoor sign mounting system which offers flexibility in installation while still being of sturdy construction.

Therefore, in accordance with a general aspect of the present invention, there is provided a system for mounting a sign to a post, the system comprising an elongated channel member adapted to be mounted on a backside of a sign, a bracket adapted to be mounted to a post to which the sign is to be mounted, the bracket having a channel engaging portion adapted to be slidably engaged into the channel member on the backside of the sign, wherein the bracket comprises an endless collar extending along a continuous closed line and adapted to be fitted over the post, said collar defining at least one transversally oriented hole in which a threaded fastener is threadably engaged with a leading end thereof projecting inwardly of the continuous endless collar for exerting a pushing action on the post in order to secure the collar on the post while at the same time drawing the channel member against the post so as to prevent relative movement between the sign and the bracket.

In accordance with a further general aspect of the present invention, there is provided a system for mounting a sign to a post, the system comprising a collar adapted to tightly surround a post, said collar being provided on an outer surface thereof with at least two rail engaging members each of which is located on a different side of the post once the collar has been mounted thereabout, at least one rail slidably engageable with a selected one of said at least two rail engaging members, said at least one rail being adapted to be mounted to a rear surface of a sign, thereby allowing signs to be mounted on at least two different sides of the post.

In accordance with a still further general aspect of the present invention, there is provided a system for mounting a sign to an outdoor post, the system comprising an elongated rail adapted to be mounted on a rear surface of a sign, a bracket adapted to be mounted to an outdoor post to which the sign is to be mounted, the bracket having a rail engaging portion adapted to be slidably engaged with the rail, wherein once the position of the sign relative to the post has been adjusted, further sliding movement between the rail engaging member and the rail is prevented by tightening a threaded fastener extending internally of the bracket against the outdoor post.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
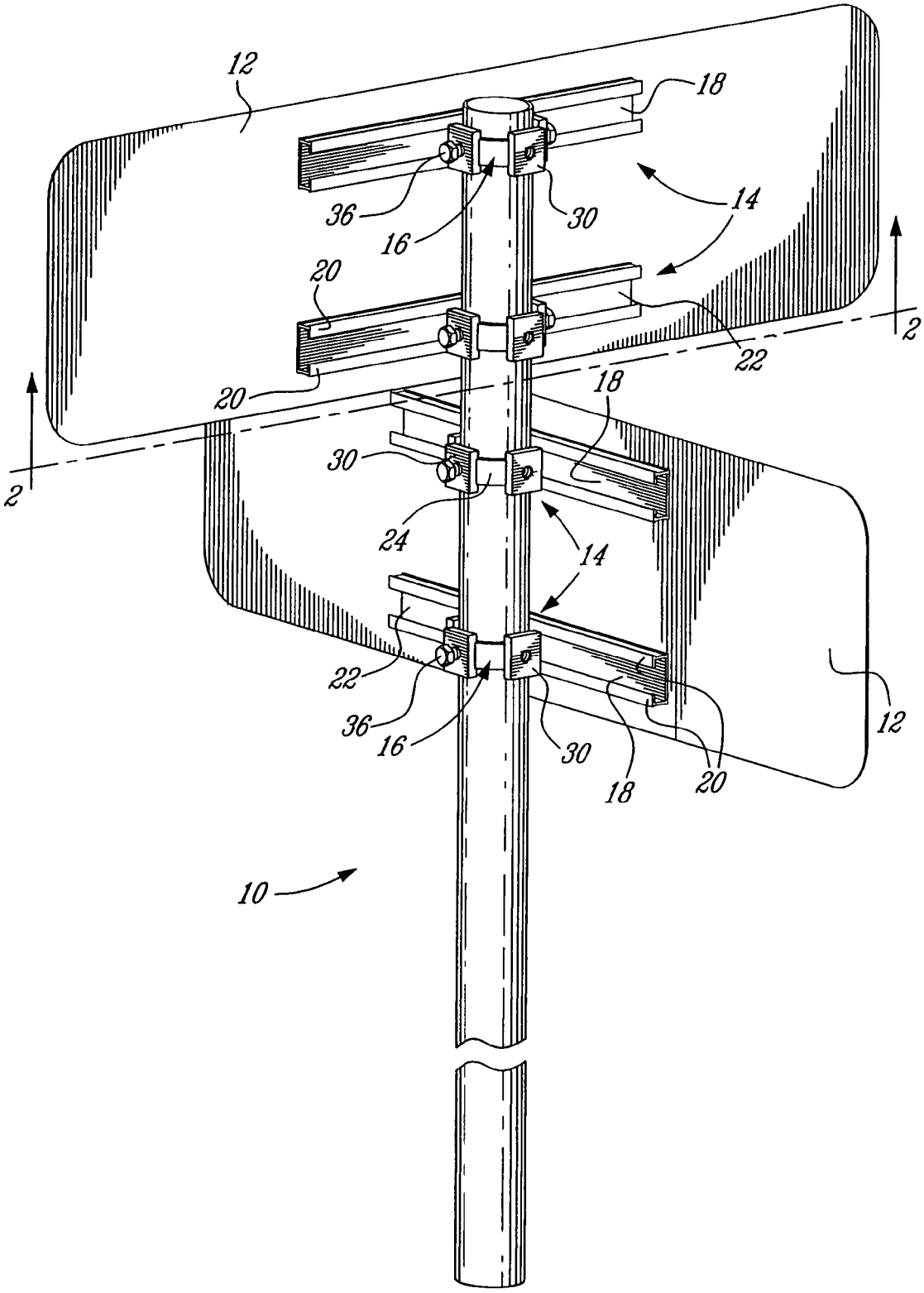
FIG. 1 is a perspective view of an outdoor sign support system comprising a number of collars engaged in channel members for mounting two signs on an outdoor post in accordance with a preferred embodiment of the present invention.

FIG. 1 illustrates an outdoor post 10 carrying two road signs 12. According to the present invention, the signs 12 are releasably secured in position on the post 10 by means of channel and collar assemblies 14.

Each channel and collar assembly 14 generally comprises a bracket preferably in the form of a one piece endless collar 16 and an elongated channel member 18 or rail. The channel member 18 is preferably adhesively secured to the rear side of the sign to be mounted on the post 10. The channel member 18 is preferably provided in the form of an aluminum extrusion and comprises a pair of inturned lips 20 defining a mouth 22 therebetween. The channel member 18 has the advantage of reinforcing the sign 12.

Figure 3:
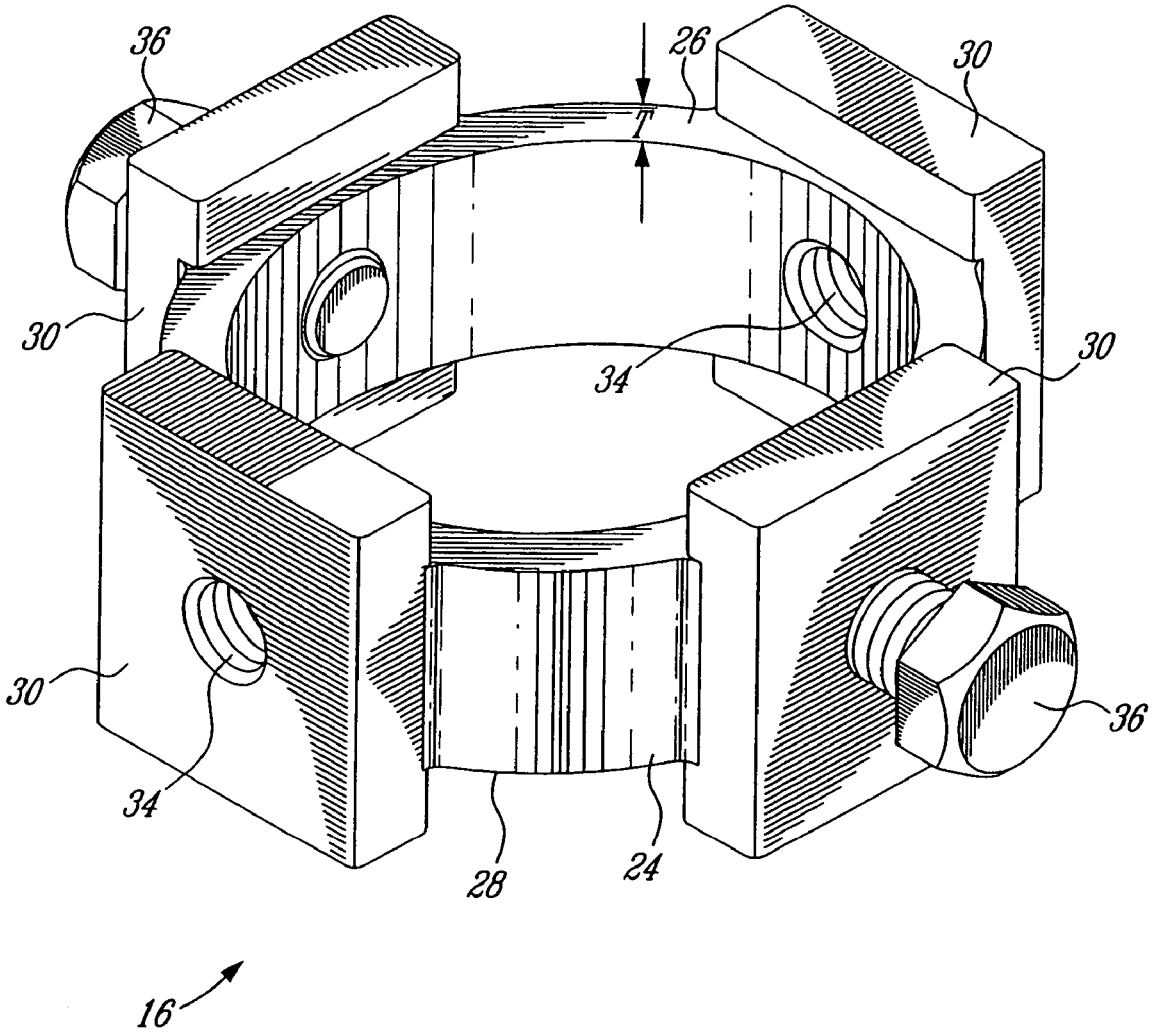
FIG. 3 is a perspective view of a collar in accordance with a preferred embodiment of the present invention.

As shown in FIG. 3, each collar 16 comprises a continuous annular band 24 defining a closed space generally corresponding to the outline of the post 10 on which the collar 16 is to be fitted over. According to the illustrated embodiment, the post and the band are elliptical, thereby limiting the angular movement of the collar 16 on the post 10 and provided added stability. It is understood that the post 10 and the collar 12 could be of other complementary shapes, such as circular, square and rectangular. The annular band 24 has a thickness T of about 1¼ in. The annular band 24 has a top surface 26 and a bottom surface 28. According to the illustrated embodiment, four square or rectangular enlarged mounting pads 30 or rail/channel engaging portions are integrally formed on the outer surface of the annular band 24. The mounting pads 30 are all tangential to the band 24 and uniformly distributed about the collar 16 (one mounting pad at every 90 degrees). The mounting pads 30 project upwardly and downwardly beyond the top and bottom surfaces 26 and 28 of the annular band 24 for engagement behind the inturned lips 20 of the channel members 18. Each mounting pad 30 projects thicknesswise from the outer surface of the band 24 and is adapted to substantially fill the channel member 18 so as to be in uniform sliding contact with the inner surface of the inturned lips 20 and the bottom surface of the channel member 18.

The thickness of each mounting pad 30 generally corresponds to the depth of the channel member 18.

A radially oriented hole 34 is defined centrally though each mounting pad 30 and through the annular band 24 for receiving a threaded fastener, such as a bolt 36. The collar 16 preferably consists of a unitary piece of aluminum and it may be obtained by extrusion. Alternatively, the collar 16 could consist of a plastic or steel casting.

Figure 2:
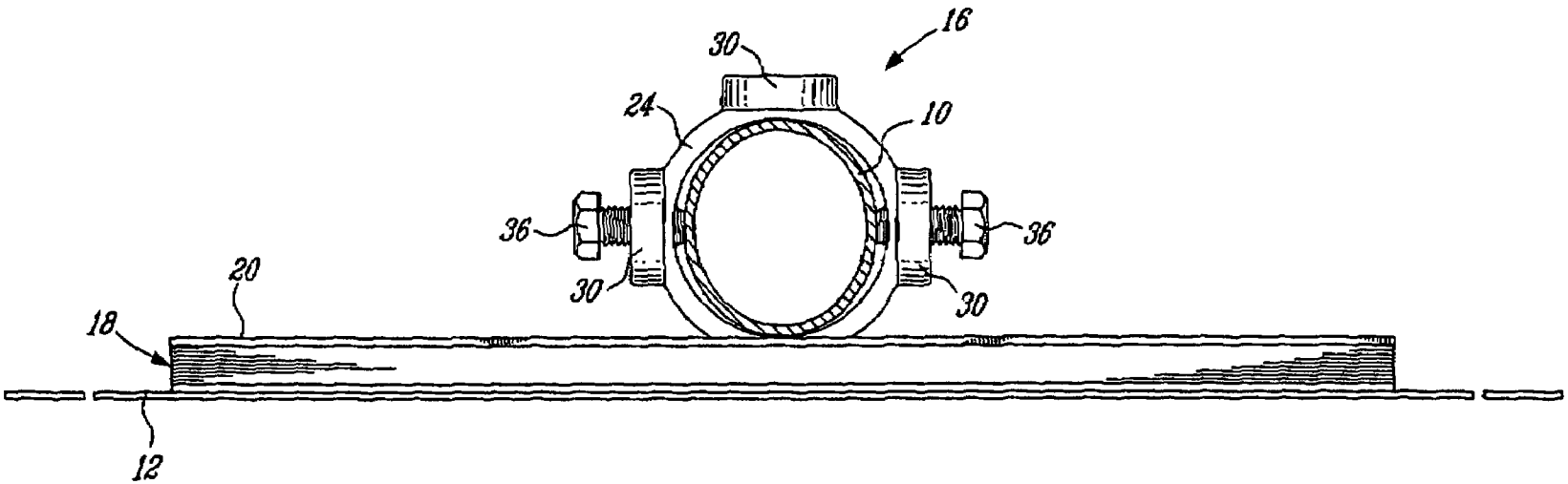
FIG. 2 is top plane cross-sectional view taken along line 2—2 in FIG. 1.

In use, at least one channel member 18 is pre-mounted to the backside of a sign or other articles to be mounted to a post. A collar 16 is fitted over the post 10 for each channel member 18 on the backside of the sign 12. The sign 12 is then mounted to the collar(s) 16 by sliding lengthwise the channel member(s) 18 from one end thereof onto a selected one of the mounting pads 30 of the collar(s) 16. This advantageously permits to install the sign 12 on all sides of the post 10. By sliding the channel member(s) 18 on the mounting pad(s) 30, the position of the sign 12 relative to the post 10 in a horizontal plane can be easily adjusted. The vertical position of the sign 12 is adjusted by sliding the collar(s) 16 vertically along the post 10. In the case of a circular post and circular collar(s), the angular position of the sign 12 on the post 10 can be easily adjusted by rotating the collar(s) on the post 10. In the case of elliptical or square posts 10, the plurality of mounting pads 30 on each collar 16 still provides for the mounting of the sign 12 on a desired side of the post 10. Once the position of the sign 12 on the post 10 has been set, the collar(s) 16 is/are secured in position on the post by either 1) tightening one bolt 36 in the mounting pad 30 opposite to that on which the sign 12 is supported (see bottom sign 12 in FIG. 1) or 2) tightening two bolts in the two lateral mounting pads 30 adjacent the one used to support the sign 12 (see FIG. 2). The second securing alternative will be notably used when a second sign is to be installed on the mounting pad 30 opposite the mounting pad 30 supporting the first sign or when a single collar 16 is used to support a sign 12. However, in either case, the tightening of the bolt(s) 36 will induce an elastic deformation in the collar 16 as a result of the pushing action of the leading end of the bolt(s) 36 on the post 10. As shown in FIG. 2, the elastic deformation of the collar 16 causes the mounting pad 30 supporting the sign 12 to be drawn towards the post 10, thereby securely wedging the inturned lips 20 of the channel member 18 between the post 10 and the mounting pad 30 supporting the sign 12. In this way, the collar 16 is secured to the post 10 and the mounting pad 30 is secured into the channel member 18 in a single operation.

This way of mounting a sign to a post has the advantage of being very strong and reliable overtime. Also, all the mounting hardware is concealed behind the sign which provides a more esthetic aspect to the post. Furthermore, it provides for numerous vertical, horizontal and angular adjustment of the position of the sign on the post. Another advantage of the present concept resides in the fact that one collar 16 can be used to mount more than one sign to the post. Also, the sign can be selectively installed on a desired side of the post irrespective of the angular orientation of the post in the ground. In short, the present system provides great flexibility in installation while being of a sturdy construction and easy to use.

The embodiments of the invention described above are intended to be exemplary. Those skilled in the art will therefore appreciate that the forgoing description is illustrative only, and that various alternatives and modifications can be devised without departing from the spirit of the present invention. Accordingly, the present is intended to embrace all such alternatives, modifications and variances which fall within the scope of the appended claims.

What is claimed is:

1. A system for mounting a sign to a post, the system comprising an elongated channel member adapted to be mounted on a backside of the sign, a bracket adapted to be mounted to the post to which the sign is to be mounted, the bracket having a channel engaging portion adapted to be slidably engaged into the channel member on the backside of the sign, wherein the bracket comprises an endless collar adapted to be fitted over the post, said collar defining at least one transversally oriented hole in which a threaded fastener is threadably engaged with a leading end thereof projecting inwardly of the endless collar for exerting a pushing action on the post in order to secure the collar on the post while at the same time drawing the channel member against the post so as to prevent relative movement between the sign and the bracket.

2. A system as defined in claim 1, wherein said collar has a top edge and a bottom edge, and wherein said channel engaging portion extends beyond said top and bottom edges.

3. A system as defined in claim 2, wherein said channel engaging portion is integrally provided on an outer surface of said collar.

4. A system as defined in claim 3, wherein said channel engaging portion is provided in the form of an enlarged mounting pad on said outer surface of said collar.

5. A system as defined in claim 4, wherein at least two enlarged mounting pads are provided at different locations on said outer surface of said collar.

6. A system as defined in claim 5, wherein two pairs of diametrically opposed mounting pads are provided on said outer surface of said collar.

7. A system as defined in claim 4, wherein said at least one transversally oriented hole comprises a through hole in said enlarged mounting pad.

8. A system as defined in claim 1, wherein said collar has a generally elliptical shape.

9. A system for mounting a sign to a post, the system comprising a collar adapted to tightly surround the post, said collar being provided on an outer surface thereof with at least two rail engaging members each of which is adapted to be located on a different side of the post once the collar has been mounted thereabout, at least one rail slidably engageable with a selected one of said at least two rail engaging members, said at least one rail being adapted to be mounted to a rear surface of the sign, thereby allowing signs to be mounted on at least two different sides of the post, wherein at least one threaded hole is defined in said collar for receiving a threaded fastener, said threaded fastener having a leading end extending internally of said collar for engaging the post, and wherein said at least one threaded hole extends thicknesswise through one of said at least two rail engaging members.

10. A system as defined in claim 9, wherein said collar is provided in the form of a one-piece extrusion.

11. A system as defined in claim 9, wherein said collar is endless and extends along a continuous line circumscribing a closed space in which the pole is adapted to be received.

12. A system for mounting a sign to an outdoor post, the system comprising an elongated rail adapted to be mounted on a rear surface of the sign, a bracket adapted to be mounted to the outdoor post to which the sign is to be mounted, the bracket having a rail engaging portion adapted to be slidably engaged with the rail, wherein once the position of the sign relative to the post has been adjusted, further sliding movement between the rail engaging portion and the rail is prevented by tightening a threaded fastener extending internally of the bracket against the outdoor post, wherein said bracket includes an endless collar defining a closed space for receiving the post, wherein a threaded hole is defined thicknesswise through said collar for allowing said threaded fastener to project into said closed space in order to engage the post, and wherein said rail engaging portion is provided in the form of a mounting pad integrally formed on an outer surface of said collar, said mounting pad projecting beyond an upper edge and a bottom edge of said collar.

13. A system as defined in claim 12, wherein a plurality of rail engaging portions are provided at different locations about said collar.

* * * * *